United States Patent [19]

Keller, Jr. et al.

[11] Patent Number: 4,515,602

[45] Date of Patent: May 7, 1985

[54] COAL COMPOSITIONS

[75] Inventors: Douglas V. Keller, Jr., Lafayette; Frederick J. Simmons, Syracuse, both of N.Y.

[73] Assignee: Otisca Limited, Ltd., Syracuse, N.Y.

[21] Appl. No.: 406,730

[22] PCT Filed: Jun. 10, 1982

[86] PCT No.: PCT/US82/00790

§ 371 Date: Jun. 10, 1982

§ 102(e) Date: Jun. 10, 1982

[87] PCT Pub. No.: WO83/04416

PCT Pub. Date: Dec. 22, 1983

[51] Int. Cl.[3] ..... C10L 1/32

[52] U.S. Cl. ..... 44/51; 44/72; 252/352; 252/357

[58] Field of Search ..... 44/51, 72; 252/352, 252/357

[56] References Cited

U.S. PATENT DOCUMENTS

| | | | |
|---|---|---|---|
| 2,422,515 | 6/1947 | Anderson | 44/72 |
| 3,517,628 | 6/1970 | Harnsch et al. | 110/101 |
| 3,682,114 | 8/1972 | Scheubel | 110/75 |
| 3,762,887 | 10/1973 | Clancey et al. | 44/51 |
| 3,764,547 | 10/1973 | Schlinger et al. | 44/51 |
| 4,282,006 | 8/1981 | Funk | 44/51 |
| 4,302,212 | 11/1981 | Yamamura | 44/51 |
| 4,304,572 | 12/1981 | Wiese et al. | 44/51 |

FOREIGN PATENT DOCUMENTS

| | | | |
|---|---|---|---|
| 0025278 | 3/1981 | European Pat. Off. | 44/51 |
| 1600865 | 10/1981 | United Kingdom | 44/51 |

OTHER PUBLICATIONS

Aoki et al., Pretreatment of Coal for Coal Water Slurries, 1982.

Borio et al., Coal-Oil Mixture and Coal-Water Mixture Fuels for Steam Generators, 1982.

Germane et al., Coal-Water Mixture Combustion Studies in a Laboratory Cylindrical Combustor, 1982.

Ghassemzadeh et al., Rheology and Combustion.

Scheffee et al., Further Development and Evaluation of Cool-Water Mixture Technology, 1982.

*McCutcheon's Detergents and Emulsifiers*, 1967 annual, Witco Chemical, New York, New York, pp. 34 and 94.

*Primary Examiner*—William R. Dixon, Jr.

*Assistant Examiner*—Margaret B. Medley

*Attorney, Agent, or Firm*—LeBlanc, Nolan, Shur & Nies

[57] ABSTRACT

Compositions containing coal and water which can be used as fuels and for other purposes such as feedstocks for coal gasification and liquefaction processes. In addition to the coal and water the composition may contain a minor amount of an organic or inorganic composition capable of reducing the viscosity of the coal-water system.

10 Claims, 2 Drawing Figures

COAL COMPOSITIONS

TECHNICAL FIELD OF THE INVENTION

The present invention relates to coal compositions and, more particularly, to novel, improved coal-water mixtures which can be used as fuels and as feedstocks for coal gasification and liquefaction processes.

Dwindling supplies of petroleum and natural gas and concerns about the regular availability of those products from foreign sources have led to increased interest by utilities and other consumers in the use of coal as an alternative fuel. One approach to this use of coal that is currently being investigated is the firing of coal-water mixtures or slurries. While such slurries do have drawbacks not found in conventional pulverized coals, these are not serious and are more than offset by the comparative ease with which a coal-water slurry can be handled.

BACKGROUND ART

The coal-water slurries reported in the patent and open literature for the most part have particle size distributions of 60–80 percent ±200 mesh (74 μm)×0 and ash contents of 3+ to over 10 wt percent. Such mixtures are described in U.S. Pat. Nos. 3,517,628 issued June 30, 1970, to H. Harnisch et al; 3,682,114 issued Aug. 8, 1972, to F. Scheubel et al; 3,762,887 issued Oct. 2, 1973, to Clancey et al; 3,764,547 issued Oct. 9, 1973, to Schlinger et al; 4,282,006 issued Aug. 4, 1981, to J. Funk; and 4,304,572 issued Dec. 8, 1981, to H. Wiese et al and in the following papers, all presented at the 4th International Symposium on Coal Slurry Composition, Orlando, Fla., May 10–12, 1982: K. Aoki et al, Pretreatment of Coal for Coal Water Slurries, Sumitomo Heavy Industries, Ltd.; R. Borio et al, Coal-Oil Mixture and Coal-Water Mixture Fuels for Steam Generators, Combustion Engineering, Inc.; G. Germane et al, Coal-Water Mixture Combustion Studies in a Laboratory Cylindrical Combustor, Combustion Laboratory, Brigham Young University; M. Ghassemzadeh et al, Rheology and Combustion Characteristics of Coal-Water Mixtures, Babcock and Wilcox Company; and R. Scheffee et al, Further Development of and Evaluation of Coal-Water Mixture Technology, Atlantic Research Corporation.

The Borio et al paper does refer to one slurried coal—identified as super clean beneficiated—that reportedly has an ash content of 1.1 wt. %. However, that is not on a moisture-free basis, meaning that the ash content of the coal on that basis is over two wt. %.

Furthermore, the seam from which the raw coal was mined is not identified. Consequently, the reported ash content of the product coal may or may not be particularly notable.

Also of importance is that the particle size distribution of the coal in the slurry described by Borio is only 85% 44 μm×0. As a consequence, the substitution of that slurry for the existing fuel in an electrical generating unit, for example, would be apt to require extensive—and correspondingly expensive—retrofit of the steam generator; and a significant derating of the generator might result.

DISCLOSURE OF THE INVENTION

The novel coal-water slurries disclosed herein differ from those described above in that they have a particle size distribution of ≧95 percent ≦30 m . 0 and an ash content that can range down to 1.5–<0.3 wt. percent.

As a result, they have superior combustion characteristics; and deratings can be minimized in oil-to-coal and other conversion schemes. Also ash handling, erosion and corrosion, and emission control are significantly less of a problem.

Typical properties of a slurry in accord with the principles of the present invention are tabulated below:

TABLE L

| | |
|---|---|
| Particle Size Distribution | 11 μm × 0 |
| Total Sulfur Content Wt. % | 0.4 |
| Ash Content Wt. % | 0.3 |
| Solids Contest Wt % | 70 |
| BTU/Lb of Slurry | 10,500 |

Coal-water slurries of the character just described can (but do not necessarily have to be) prepared by milling or otherwise comminuting raw coal until it has been reduced in particle size to ≧95 percent ca. 250 μm×(μm equals micrometer or micron). The raw coal is then slurried in an aqueous liquid, typically clean water; and comminution of the raw coal is continued until the raw coal has been resolved into separate, particulate phases of coal and mineral matter and the size distribution has been altered to ≧85 percent 30−≦15 μm×0.

After this comminution step is completed, a large amount of an agglomeration agent or agglomerant is added to the slurry with agitation; agitation of the slurry is continued until the coal particles have dissociated from the mineral matter and aqueous phases of the slurry and coalesced into agglomerates of product coal; and the agglomerates are recovered from the slurry (there is virtually 100 percent recovery of the carbonaceous material in this separation).

Thereafter, the agglomerant is evaporated from the mixture of product coal and agglomerates. This dissociates the particles making up the agglomerates, leaving the wanted mixture or slurry of coal particles and water.

The water content of the coal-water mixture can be brought to the desired level during the process discussed above by increasing the temperature of the product coal-water mixture during the step in which the agglomerant is evaporated from it to a level at which water will also evaporate.

To be practical, i.e., pumpable and atomizable with an acceptable energy input, a coal-water slurry as disclosed herein must have an absolute viscosity of ≦20,000 centipoises with the lower the viscosity the better holding true. Where the two-component (coal and water) mixture does not meet this criteria, a viscosity of an appropriate level can be obtained by mixing a surface active viscosity modifier with the two-component system in an amount sufficient to reduce the viscosity of the slurry to the desired level. From 0.8 to 1.0 pounds of surface active agent per 100 pounds of coal in the slurry (dry weight) will typically be employed. However, greater or lesser amounts can also be used depending upon such factors as the particular coal in the slurry, the surface active agent used, the solids concentration, and the target viscosity.

Both cationic and non-ionic viscosity modifiers can be used for the purposes just described.

Those that are suitable include Aersol A-102, a disodium ethoxylated alcohol ($C_{10}$–$C_{12}$) half ester of sulfosuccinic acid marketed by American Cyanamid Co. and Whitcote Emcol P10-59, an amine salt of dodecylbenzene sulfonic acid marketed by Witco Chemical Corporation. Other potentially appropriate surface active compositions are described in, for example, the above cited Germane et al and Scheffee et al papers and in U.S. Pat. No. 4,302,212 issued Nov. 24, 1981, to M. Yamamura et al.

The surface active viscosity modifier is homogenously blended with the coal-water mixture in a high or low shear mixer, in an ultrasonic blender, or by any other technique that is desired until a uniform dispersion of the viscosity modifier is obtained.

Reductions in the viscosity of the two-component system can also be obtained by uniformly dispersing an inorganic compound such as ammonium hydroxide in the system.

From ca. 1 to 2 weight percent of the inorganic compound based on the dry weight of the coal has been successfully used. This amount can be varied depending upon factors such as those discussed above in conjunction with organic viscosity modifiers. Again, any type of blending equipment deemed appropriate may be employed to disperse the viscosity modifier.

To be burned satisfactorily, a coal-water slurry must have a solids concentration of at least 50, and preferably 60, wt. %. The slurries disclosed herein can easily be made to meet this minimum solids concentration criterion, and slurries with higher concentration of solids (up to 90 wt %) can be prepared with equal ease.

Coal-water mixtures or slurries in which the coal has an even lower ash content than is available from following the steps identified above can be produced by redispersing the product coal agglomerates in clean water and repeating the agglomeration and collection steps. This sequence can be repeated as many times as wanted although it is presently believed that the benefits obtained by proceeding beyond the third collection step will in general not justify the expense of doing so.

Still another technique that can be employed to reduce the ash content of the coal in the coal-water slurry is an acid leach of the coal obtained from the ash reduction step(s) described above. One suitable composition for this purpose is 4 normal nitric acid.

To keep the ash content of the slurry at a minimum in a three component-coal-water-viscosity modifier system, a non-ashing modifier is employed. The above-described Whitcote Emcol P10-59 is one example of a composition of that character. Ammonium hydroxide is another.

By employing the techniques described above, one can prepare slurries in which the coal has a size distribution of $+95$ percent $\leqq 15\ \mu m \times 0$; an average particle size of 2 to 4 $\mu m$, which allows even and complete combustion; and an ash content ranging down to less than 0.3 weight percent. The slurry may have an absolute viscosity as low as 100–200 centipoises and a heat content of 10,500 BTU/lb of slurry or higher depending upon the particular coal in the mixture. As fuels, these novel slurries can compete directly with No. 6 fuel oil and with Bunker C and residual crude oils in terms of performance, and they are materially cheaper.

The novel slurries disclosed herein can be substituted for both conventional pulverized coal and petroleum-based fuels without major retrofit of existing equipment. The flame characteristics of these slurries lie between those of flames obtained by burning natural gas and No. 2 fuel oil, respectively Reductions in ash content to the levels envisaged herein require an agglomerating agent of particular character; viz., one that has an exceptionally high interfacial tension with water (at least 50 dynes/cm and the higher the better) and a reasonably low viscosity. Suitable agglomerants include such diverse compounds as pentane, 2-methylbutane, 1,1,2-trichloro- 1,2,2-trifluoroethane, and trichlorofluoromethane. Essentially pure compounds are required as even small amounts of impurities markedly lower the interfacial tension of the agglomerant with respect to water. From 45 to 65 wt percent of agglomerant is employed based on the weight of the coal phase in the raw coal being processed.

Partially oxidized and lower ranked coals are preferably treated with an appropriate surface active agent prior to agglomeration and separation to modify the naturally hydrophilic surfaces of the coal and, in effect, transform it into a hydrophobic coal that responds to the process in the same manner as a naturally hydrophobic, unoxidized high rank coal.

The surface active agent, which may be oleic acid or one of its soluble salts, is preferably mixed with the raw coal slurry in an amount sufficient to produce a monolayer of surfactant on the coal. Excess surfactant must be avoided as the excess will significantly reduce the interfacial energy between the agglomerant and the water in the slurry, causing an increase in the ash content of the product coal agglomerants. To avoid this same undesirable result, care must be exercised to avoid the use of surfactants that would render the surfaces of the mineral matter particles in the slurry hydrophobic.

Strong Lewis bases can also be employed to induce hydrophobicity in partially oxidized and lower ranked coals. Lewis base-containing compounds that can be employed for the purposes just described are those of the formulas ROH, $R_2NH$, $RNH_2$, and $R_3N$ where R is an organic chain or ring with more than four carbons.

Several important advantages of the novel coal-water slurries disclosed herein have been described above. Another is that, because of their uniquely low ash contents, the chemistry of such slurries can be optimized without increasing ash to an unacceptable level. For example, this low ash content makes it possible to add CaO to the slurry as a getter for $SO_2$ and still keep the ash content of the coal well below one percent.

In addition, such slurries have a constant fuel chemistry, an advantage of obvious importance. Also, ash-forming compositions are not needed to generate the slurry as is the case of those described in the above-cited Funk patent, for example.

Another important advantage of the present invention is that it is not coal-type specific. Slurries as disclosed herein can be generated from coal ranging from lignite through sub-bituminous and bituminous to anthracite. And, as discussed above, oxidized, as well as unoxidized, coals can be converted into such slurries.

OBJECTS OF THE INVENTION

The primary object of the present invention resides in the provision of novel, improved coal-water slurries.

Other important but more specific objects of the invention reside in the provision of slurries as described in the preceding object:

which, as fuels, are competitive with No. 6 fuel oil and other petroleum fuels;

which can be substituted for petroleum fuels and conventional pulverized coal fuels with, at most, only a modest derating of the equipment in which the slurry is burned and without extensive retrofit of the equipment;

which, as fuels, are capable of reducing the magnitude of such problems as ash handling, erosion and corrosion, and emission control;

which have an extremely low ash content and a high BTU content;

which can readily be made available on commercial scales;

which can be produced in equipment that is relatively uncomplicated, that only needs low maintenance, that is simple to operate, and that can be made available with only a modest capital investment;

which can be produced from coals ranging from lignite through sub-bituminous to anthracite;

which can be uniformly and completely burned and which have a constant fuel chemistry;

which can be readily pumped and atomized with acceptable expenditures of energy.

Additional important objects and advantages of the invention and other novel features thereof will be apparent to the reader from the foregoing; from the appended claims; and as the ensuing detailed description and discussion of the invention proceeds in conjunction with the accompanying drawing.

PREFERRED EMBODIMENTS OF THE INVENTION

Figure 1:
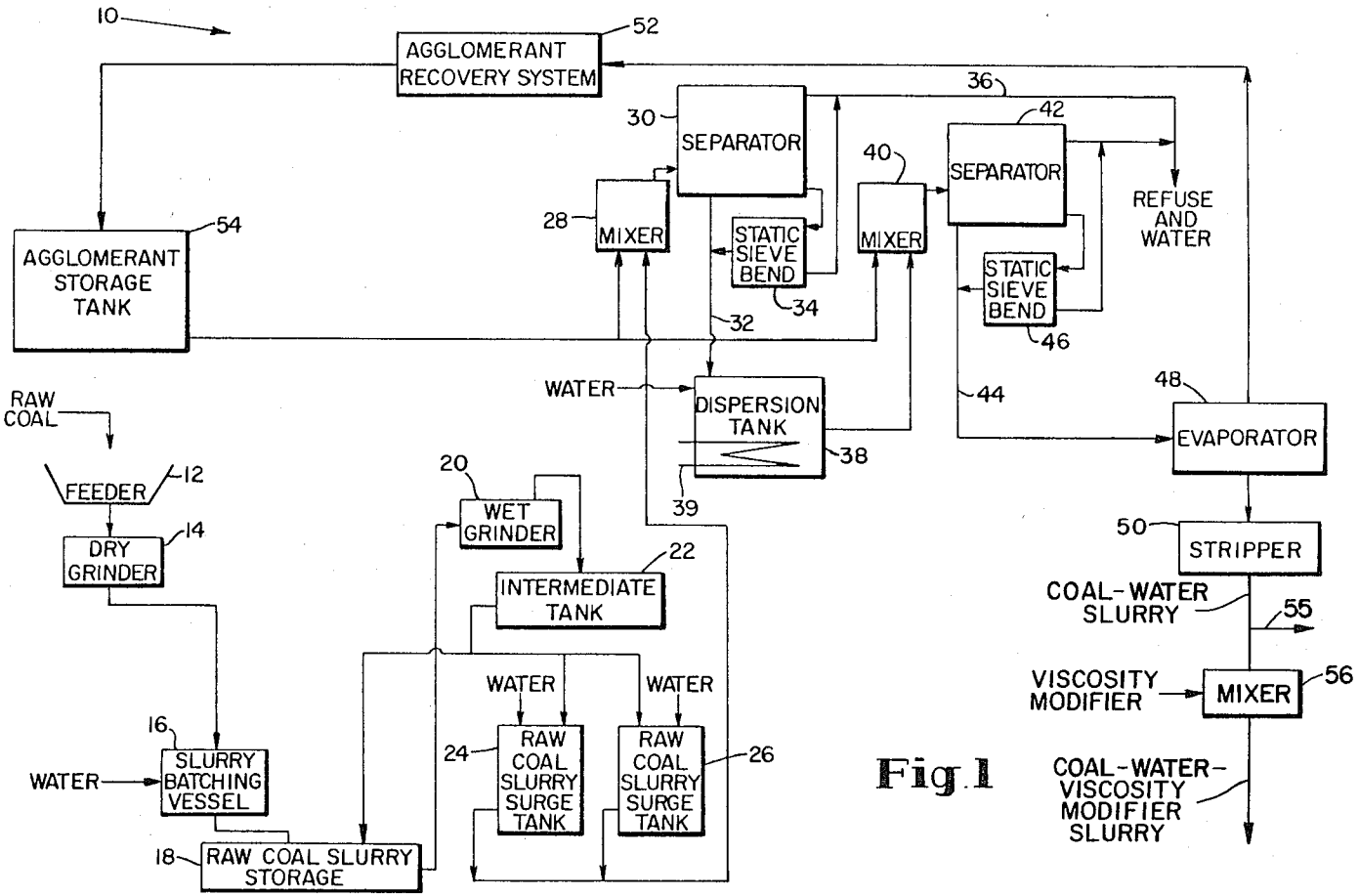
FIG. 1 is a schematic diagram of a plant in which coal-water slurries in accord with the principles of the present invention can be generated.

Referring now to the drawing, FIG. 1 schematically depicts a plant 10 in which raw coal can be converted to a low ash coal-water slurry having the characteristics discussed above.

In terms of process steps, the first major component of plant 10 is feeder 12 which transfers the raw coal being processed to a dry grinder 14 which may be, for example, an impact mill, ball mill, race mill or the like. Dry grinder 14 is employed to reduce the raw coal to a size consist typically about 85 percent 250 $\mu m \times 0$. From dry grinder 14, the pulverized raw coal is transferred to a slurry batching vessel 16. Here, the raw coal is mixed with clean water to form an aqueous slurry having a solids content in the range of 20 to 70 wt %.

The raw coal slurry is transferred to a slurry storage tank 18 from a batching vessel 16. This tank provides a capacitance in the system; i.e., it permits plant 10 to be operated continuously notwithstanding the fact that several steps in the process are carried out in batch fashion.

From raw coal slurry storage tank 18, the slurry is transferred to a wet grinder 20 where the raw coal is reduced to a particle size distribution preferably on the order of 95% 30 $- \leqq 15$ microns$\times 0$ with smaller top sizes being preferred because this results in a fuel which can be more efficiently and uniformly burned. The wet grinder may be, for example, a ball mill, stirred ball mill, vibratory mill, roll mill, etc.

From wet grinder 20, the raw coal slurry is transferred to an intermediate tank 22. This tank is provided so that quality control checks can be performed before the recovery of the product coal from the mineral matter and aqueous phases of the slurry is effected. Out-of-specification material is returned to slurry storage tank 18 for reprocessing through wet grinder 20.

If the slurry is within specifications, it is transferred to one of two raw coal slurry surge tanks 24 and 26. Water is added to the slurry transferred to the surge tanks to dilute the slurry to a solids concentration of about 1 to 15 weight percent. This promotes the subsequent separation of the product coal particles from the associated mineral matter in the slurry and the aqueous carrier.

Also, like storage tank 18, surge tanks 24 and 26 provide capacitance in the slurry preparation system. This provides independence of operation between the milling circuit just discussed and the next-to-be discussed circuit in which the product coal particles are separated, agglomerated, and recovered from the slurry. This circuit isolation is desirable because, in the event of malfunction of any of the interconnecting components, the subsequent stages can operate for a substantial period of time without interruption of subsequent unit processes.

Referring again to the drawing, the more dilute, raw coal slurry is transferred alternately from surge tank 24 and surge tank 26 to mixer 28 where the selected agglomerant is added to and mixed with the slurry. From mixer 28, the slurry is transferred to separator 30 which may be a rotating drum or a spheroidizer. Here, the dissociation of the slurry and the formation of product coal agglomerates initiated in mixer 28 are continued and the agglomerates dimensionally stabilized; and water is expelled from the agglomerates, contributing to the quality of the product.

A fraction of the product coal agglomerates are recovered and discharged directly from separator 30 as indicated by line 32 in the drawing. The remainder of the agglomerates and the aqueous and dispersed mineral phases of the slurry are discharged to a static sieve bend 34. Here, the remainder of the product coal agglomerates are recovered while the water and mineral matter are discharged into a refuse circuit shown schematically in the drawing and identified by reference character 36.

To accomplish further ash reduction, the agglomerates recovered from separator 30 and sieve bend 34 are transferred to a dispersion tank 38 equipped with a heater 39 where they are mixed with sufficient clean water to reduce the concentration of solids to on the order of not more than about 30 to 10 wt %. At the same time, the concentration of the agglomerant is lowered to 20–30 wt % based on the weight of the solids in the slurry, typically by evaporating part of the agglomerant from the slurry. Heater 39 may be employed to supply any thermal energy necessary for this purpose that is not available from the ambient surroundings.

Upon being reduced to the level or concentration just identified, the agglomerant becomes incapable of bonding together the particles of product coal making up the agglomerates. Those particles consequently dissociate and disperse in the aqueous carrier of the slurry, freeing and dispersing in the aqueous carrier any particles of mineral matter that may have been entrapped in the agglomerates in the initial coal recovery and agglomeration step.

From tank 38, the aqueous slurry of redispersed coal particles and liberated mineral particles is transferred to a mixer 40 which may be of the same character as the mixer 28 discussed previously. Here, sufficient agglomerant is mixed with the slurry to again increase its concentration to the 45 to 60 wt % of agglomerant based on dry coal weight required for efficient agglomeration and recovery of the product coal.

The aqueous slurry of redispersed coal particles, freed mineral particles, and agglomerant is next transferred to a separator 42 which may duplicate separator 30. After agglomeration and stabilization of the agglomerates is completed, a fraction of the coal particle agglomerates are separated and discharged directly from the separator as indicated by line 44. The remainder of the agglomerates, together with the additional mineral matter dissociated from the coal in separator 42 and the aqueous carrier, are passed over a static bend sieve 46, the coal being discharged to line 44 and the water and mineral matter to refuse circuit 36.

The combined fractions of product coal agglomerates from separator 30 and separator 42 are processed seriatim through an evaporator 48 and a stripper 50. The agglomerant is recovered from the agglomerated coal particles in these units; circulated to an agglomerant recovery system 52 where it is freed of non-condensible gases and condensed; and then returned to agglomerant storage tank 54 (evaporator 48 can also be employed to reduce the liquid content of the coal-water mixture processed through it to the wanted level). The mixture of water and dispersed mineral matter in circuit 36 may be transferred to an agglomerant scrubber (not shown) to reduce the agglomerant content of the refuse. Thereafter, the agglomerant is combined with that recovered from the product and elsewhere in system 10.

The slurry passes to a conventional thickener(also not shown) where the water is clarified and recycled. The now semisolid refuse is transferred to a landfill, for example.

At this stage the preparation of the coal-water slurry contemplated herein may be complete as indicated by line 55 in FIG. 1. Perhaps more typically, however, the mixture will be transferred to a mixer 56 where a viscosity modifier is uniformly dispersed in the mixture to reduce its viscosity.

As indicated above, mixer 56 may be a high shear mixture like mixers 28 and 40, a low shear mixer, an ultrasonic mixer, or virtually any other type. Essentially the only criteria is that the mixer be capable of effecting a homogeneous dispersion of the viscosity modifier in a reasonable amount of time at an acceptable cost.

The examples which follow show how coal-water slurries in accord with the principles of the present invention can be prepared and otherwise illustrate various novel facets and salient points of the invention.

In the tests described in the examples the viscosities of the coal-water slurries were measured with a Haake Rotoviscometer model RV-3 using the MK-50 measuring head and the MV-II P sensor system. All studies were conducted at 20° C. varying the shear rate as a function of time from zero to 113 seconds$^{-1}$.

EXAMPLE I

A sample of raw coal from the Blue Gem seam was dry milled to 250 $\mu m \times 0$ in a hammer mill and mixed with tap water to a 30 wt % solids concentration. The pH of the resulting slurry was adjusted to 8 by adding sodium hydroxide, and the slurry was then ground in a laboratory ball mill for 16 hours. The resulting slurry was removed from the ball mill and diluted to 10 wt % solids. The diluted slurry was placed in a Waring Blender and 50 wt % (based on dry coal) of 1,1,2-trichloro- 1,2,2-trifluoroethane was added with the blender running to separate and agglomerate the coal particles. Upon agglomeration (30–60 sec) the contents of the blender were removed and passed over a sieve bend which retained the coal agglomerates and allowed the mineral matter-water slurry to pass.

The particles making up the product coal agglomerates were redispersed by adding sufficient water to produce an aqueous slurry with a solids content of ca. 10 wt % and allowing agglomerant to evaporate until the agglomerates could be seen to have dissociated. Agglomeration of the redispersed particles and separation of the agglomerates that formed were effected using the procedure described above; and the sequence of redispersion, agglomeration, separation, and dissociation of the agglomerates was repeated.

This resulted in a coal-water slurry with a solids concentration of 50 wt % and an absolute viscosity of 3300 centipoises at a shear rate of 5$^{-1}$ sec.

The particle size distribution of the coal in the slurry was determined by using a Micromeretics Instrument Corp. Sedigraph 5500 L particle size analyzer to be as follows:

TABLE 2

| Mean Particle Diameter Micrometers ($\mu$m) | Mass Percent Less Than Mean Particle Diameter |
|---|---|
| 11.3 | 99.99 |
| 8.0 | 93.9 |
| 5.7 | 85.4 |
| 4.0 | 67.5 |
| 2.8 | 51.8 |
| 2.0 | 37.8 |
| 1.4 | 26.4 |
| 1.0 | 17.6 |
| 0.71 | 11.5 |
| 0.5 | 5.74 |

The coal had the following analysis:*

Weight % Ash: 0.3

Weight % Sulfur: 0.6

Weight % Volatile Matter: 40

*All data based on dry coal weight and on a moisture-free

EXAMPLE II

Figure 2:
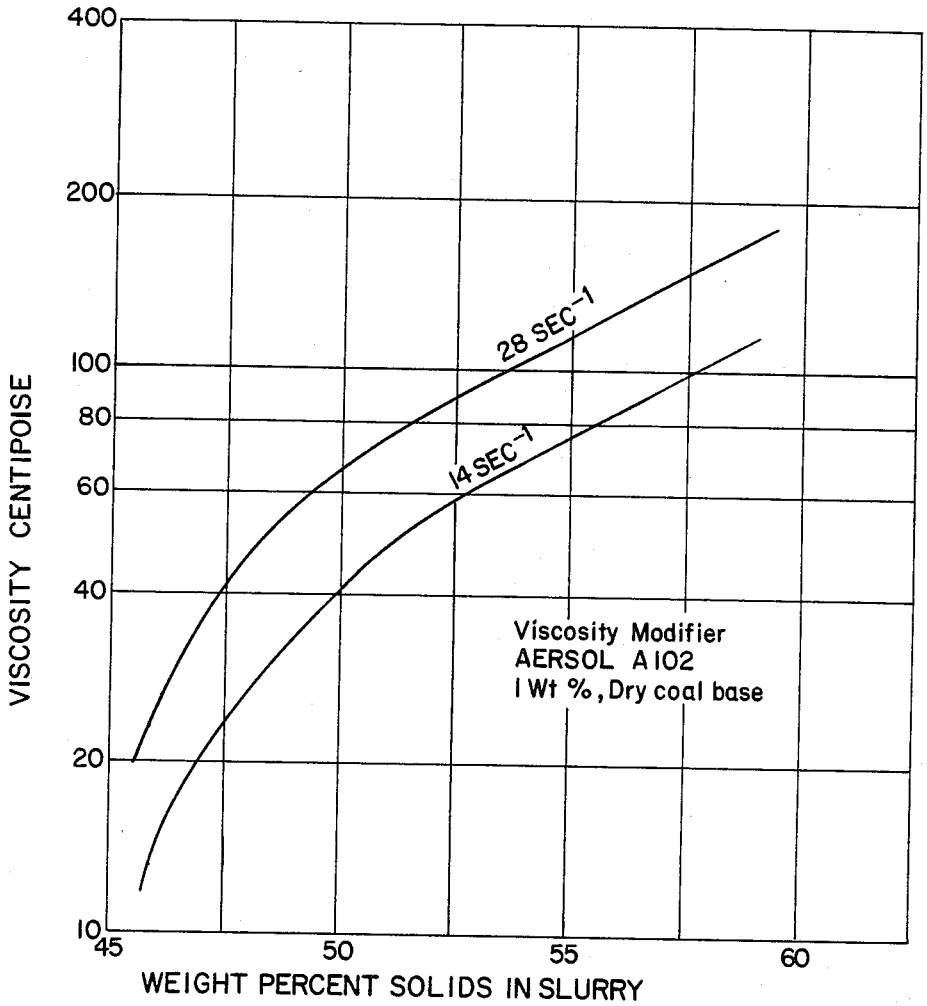
FIG. 2 is a graph showing the effect that one exemplary organic viscosity modifier has on the viscosity of a representative coal-water slurry embodying the principles of the present invention.

Example I was repeated also using a coal from the Blue Gem seam. After the final collection, Aersol A-102 was manually mixed with the 60 wt % solids, coal-water slurry that resulted in a concentration of 1 wt % based on the dry weight of the coal in the slurry. This caused a significant decrease in the absolute viscosity of the slurry as shown by the data obtained from the test and tabulated in FIG. 2. An increase in ash content from 0.18 to 0.23 weight percent (moisture-free) based on the weight of the slurry was also observed. This is attributable to the presence of the surface active agent in the slurry.

EXAMPLE III

Example II was repeated using Whitcote Emcol P10-59 rather than Aersol A-102 to reduce the viscosity of the coal-water slurry, demonstrating that non-ashing, ionic surfactants can be employed in the practice of the present invention. The following data was obtained from the tests.

TABLE 3

| Weight % Solids | Viscosity in Centipoises | | | |
|---|---|---|---|---|
| | 14 sec$^{1}$* | 28 sec$^{-1}$ | 54 sec$^{-1}$ | 108 sec$^{-1}$ |
| 50 | 100 | 70 | 47.5 | 11.1 |
| 55 | 127 | 146 | 320 | — |
| 60 | — | 164 | 374 | — |

*Shear Rate

EXAMPLE IV

Example I was repeated, using from 0.45 to 1.80 wt % of ammonium hydroxide based on the weight of the coal in the 50 wt % solids coal-water slurry obtained from the Example I procedure to reduce the viscosity of the slurry. The viscosities of the resulting slurries were measured at a shear rate of $5^{-1}$ sec. The results are tabulated below:

TABLE 4

| Concentration of Viscosity Modifier (wt %) | Absolute Viscosity of Slurry In Centipoises |
|---|---|
| 0.45 | 3300 |
| 1.03 | 3100 |
| 1.80 | 2750 |

Ammonium hydroxide is effective at amounts of 1 wt % and higher as shown by the tabulated data. It also has the advantage that, like an ionic surfactant, it is non-ashing.

The invention may be embodied in many specific forms without departing from the spirit or essential characteristics thereof. The embodiments of the invention disclosed above are therefore to be considered in all respects as illustrative and not restrictive. The scope of the invention is instead indicated by the appended claims, and all changes which come within the meaning and range of equivalency of the claims are intended to be embraced therein.

What is claimed is:

1. A composition of matter useful as a fuel and for other purposes, said composition consisting essentially of particulate coal and water, said composition having a solids content of at least 50 weight percent based on the total weight of the composition, a particle size distribution of at least 95 percent $\leqq 30\ \mu m \times 0$, and an ash content of not more than 1.5 weight percent based on the dry weight of the coal in the composition.

2. A composition of matter as defined in claim 1 which has an ash content of not more than about 0.3 weight percent based on the dry weight of the coal in the composition.

3. A composition of matter as defined in claim 1 which has a solids content of ca. 60–90 weight percent.

4. A composition of matter as defined in claim 1 wherein the average size of the coal particles is in the range of ca. 2 to 4 $\mu m$.

5. A composition of matter useful as a fuel and for other purposes, said composition consisting essentially of particulate coal, water, and a viscosity modifier in an amount that is effective to maintain the viscosity of the composition at a level of $\leqq$ca. 20,000 centipoises, said composition having a solids content of at least 50 weight percent, a particle size distribution of at least 95 percent $\leqq 30\ \mu m \times 0$, and an ash content of $\leqq 1.5$ weight percent based on the dry weight of the coal in the composition.

6. A composition of matter as defined in claim 5 which has a solids content of ca. 60–90 weight percent.

7. A composition of matter as defined in either of the preceding claims 5 or 6 wherein the average size of the coal particles is in the range of ca. 2 to 4 $\mu m$ and the ash content of the coal is not more than about 0.3 weight percent based on the dry weight of the coal in the composition.

8. A composition of matter as defined in either of the preceding claims 5 or 6 wherein the viscosity modifier is an ionic or non-ionic surface active agent.

9. A composition of matter as defined in either of the preceding claims 5 or 6 wherein the viscosity modifier is ammonium hydroxide.

10. A composition of matter as defined in either of claims 5 or 1 which has a particle size distribution of $+95$ percent $\leqq 15\ \mu m \times 0$.

* * * * *

UNITED STATES PATENT AND TRADEMARK OFFICE

CERTIFICATE OF CORRECTION

PATENT NO. : 4,515,602

DATED : May 7, 1985

INVENTOR(S) : DOUGLAS V. KELLER, JR. ET AL

It is certified that error appears in the above-identified patent and that said Letters Patent is hereby corrected as shown below:

Change of the nameof the Assignee from "Otisca Limited, Ltd."
to -- Otisca Industries, Ltd. --

Signed and Sealed this

*Twelfth* Day of *November 1985*

[SEAL]

*Attest:*

DONALD J. QUIGG

*Attesting Officer*

*Commissioner of Patents and Trademarks*